US005305605A

United States Patent [19]

Cella

[11] Patent Number: 5,305,605

[45] Date of Patent: Apr. 26, 1994

[54] HYDRAULIC PISTON AND CYLINDER UNIT

[75] Inventor: Sergio Cella, Brescia, Italy

[73] Assignee: Simon Cella S.r.l., Italy

[21] Appl. No.: 997,902

[22] Filed: Dec. 29, 1992

[30] Foreign Application Priority Data

Jan. 14, 1992 [IT] Italy ..... BS92 A 000003

[51] Int. Cl.[5] ..... F15B 7/00; F15B 11/18; F01B 7/20

[52] U.S. Cl. ..... 60/546; 60/533; 91/167 R; 91/173; 91/176; 92/53

[58] Field of Search ..... 92/51, 52, 53, 66, 80, 92/81, 117 A, 152; 91/167 R, 173, 176, 216 R; 60/533, 546

[56] References Cited

U.S. PATENT DOCUMENTS

| | | | |
|---|---|---|---|
| 3,398,645 | 8/1968 | Nansel | 91/173 |
| 3,603,207 | 9/1971 | Parrett | 92/110 X |
| 3,609,974 | 10/1971 | Lado | 60/546 X |
| 3,624,979 | 12/1971 | Przybylski | 52/115 |
| 4,733,598 | 3/1988 | Innes et al. | 91/167 R X |
| 4,825,655 | 5/1989 | Buchl et al. | 60/546 |

FOREIGN PATENT DOCUMENTS 0296047 6/1987 Fed. Rep. of Germany .

*Primary Examiner*—Edward K. Look
*Assistant Examiner*—John Ryznic
*Attorney, Agent, or Firm*—Andrus, Sceales, Starke & Sawall

[57] ABSTRACT

An hydraulic piston and cylinder unit with a piston rod and first and second cylinders. The piston rod extends into the first cylinder, and the first cylinder extends into the second cylinder. The piston rod is connected to a first piston which divides the first cylinder into first and second chambers. A second piston, connected to the first cylinder, divides the second cylinder into first and second chambers. The second chambers of the first cylinder, and the first chamber of the second cylinder are in fluid communication such that an extension of the first cylinder causes a proportional extension of the second cylinder. A similar effect occurs during retraction of the cylinders.

10 Claims, 1 Drawing Sheet

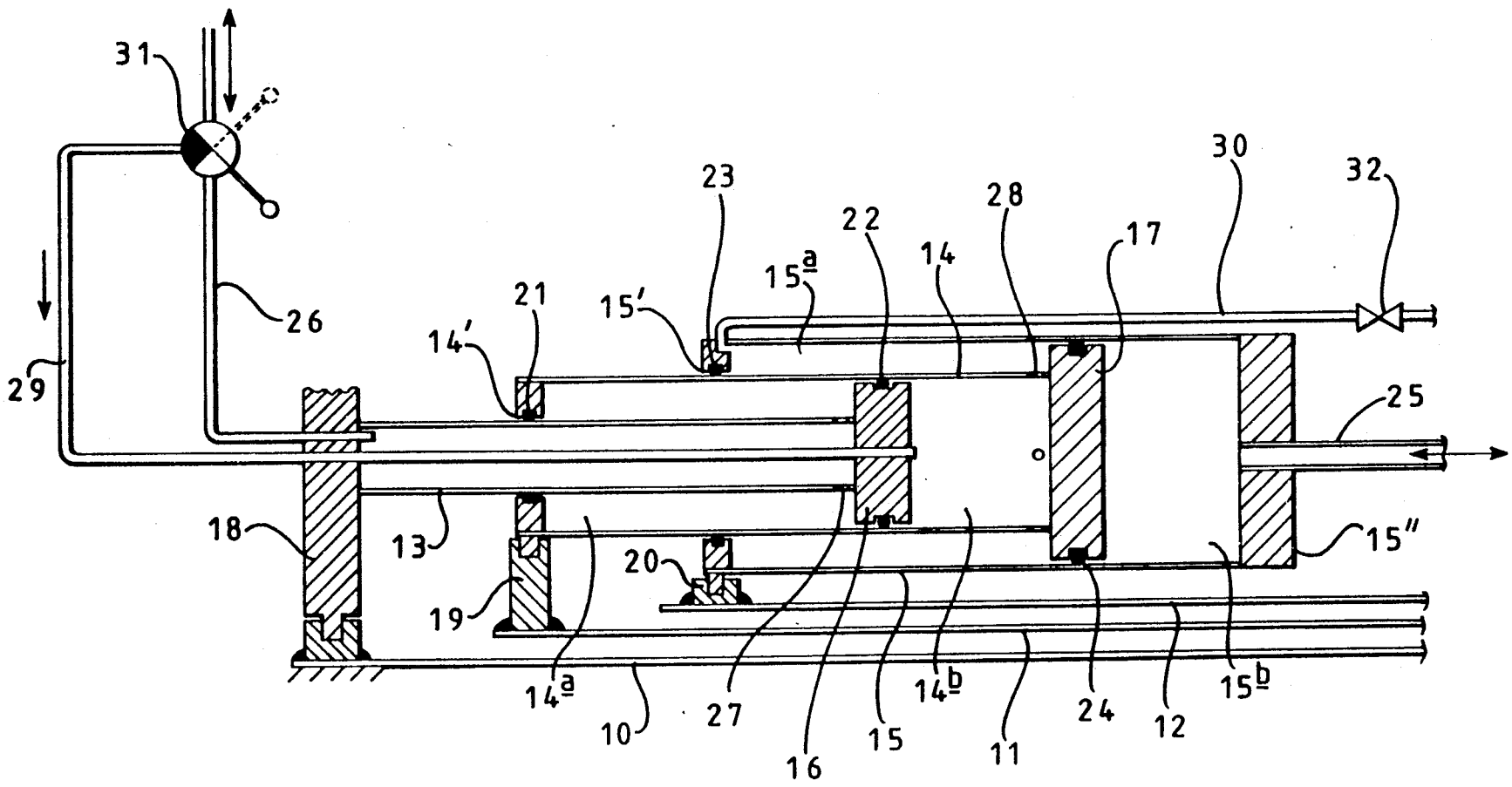
32
30
17
28
14
22
15a
23
15'
21
14'
26
31
29
25
15''
15b
12
24
11
14b
15
16
27
20
10
14a
19
13
18

HYDRAULIC PISTON AND CYLINDER UNIT

An hydraulic piston and cylinder unit comprises a piston rod and first and second cylinders. The piston rod extends into the first cylinder and is slidable relative thereto and the first cylinder extends into the second cylinder and is slidable relative thereto. A first piston is connected to the piston rod and is slidable within the first cylinder. The piston divides the first cylinder into first and second chambers. A second piston is connected to the first cylinder and is slidable within the second cylinder. The piston divides the second cylinder into first and second chambers. The second chamber of the first cylinder and the first chamber of the second cylinder are in closed fluid communication with each other via radial holes in the wall of the first cylinder. Extension of the second cylinder relative to the first cylinder causes the first chamber of the second cylinder to contract. Therefore, the second chamber of the first cylinder expands and the first cylinder extends relative to the piston rod.

The present invention relates to a piston and cylinder unit, and more particularly but not exclusively to a double acting hydraulic piston and cylinder unit capable of two or more extensions.

Hydraulic piston and cylinder units capable or two or more extensions/retractions are known but the extensions/retractions of these known units are carried out in sequence, i.e. one after another. Thus the total time for extending and retracting the unit corresponds to the sum of the individual extension/retraction times. Also, each extension requires individual fluid supply lines.

SUMMARY OF THE INVENTION

It is an object of this invention to provide a piston and cylinder unit capable of at least two extensions which can be carried out simultaneously.

According to the invention there is provided an hydraulic piston and cylinder unit comprising: a piston rod having first and second ends; a first cylinder having first and second ends; a second cylinder having first and second ends; the piston rod extending into the first cylinder through the first end of the first cylinder and being slidable relative thereto and the first cylinder extending into the second cylinder through the first end of the second cylinder and being slidable relative thereto; a first piston connected to the second end of the piston rod and slidable within the first cylinder, the first piston dividing the first cylinder into a first chamber adjacent to its first end and a second chamber adjacent to its second end; a second piston connected to the second end of the first cylinder and slidable within the second cylinder, the second piston dividing the second cylinder into a first chamber adjacent to its first end and a second chamber adjacent to its second end; and the second chamber of the first cylinder and the first chamber of the second cylinder being in closed fluid communication with each other so that extension of the second cylinder relative to the first cylinder causes extension of the first cylinder relative to the piston rod.

Preferably, means are provided for supplying fluid under pressure to the first chamber of the first cylinder in order to retract the first cylinder relative to the piston rod and cause the second cylinder to retract relative to the first cylinder. In this case, the piston rod may be hollow and in fluid communication with the first chamber of the first cylinder and the fluid supply means may be connected to the hollow piston rod.

Preferably, the piston and cylinder unit further comprises means for filling the second chamber of the first cylinder and the first chamber of the second cylinder with incompressible fluid. In this case, the filling means may include first pipe means extending through the piston rod and the first piston so as to communicate with the second chamber of the first cylinder and second pipe means connected to the second cylinder so as to communicate with the first chamber of the second cylinder.

Conveniently, the piston rod is fixed and the first and second cylinders are extendible and retractable relative to the piston rod.

There may only be two cylinders and in this case means are provided for supplying fluid under pressure to the second chamber of the second cylinder to extend the piston rod and the first and second cylinders relative to one another.

In one embodiment the piston and cylinder unit may be provided in combination with a telescopic boom having first, second and third boom members connected to the piston rod and the first and second cylinders, respectively.

The invention will now be more particularly described, by way of example only, with reference to the accompanying drawing.

BRIEF DESCRIPTION OF THE DRAWING

The single figure is a cross-sectional view of one embodiment of a piston and cylinder unit according to the invention.

DESCRIPTION OF THE PREFERRED EMBODIMENT

Referring to the drawing, the piston and cylinder unit is shown therein in combination with a telescopic boom having three boom parts 10, 11 and 12. The boom part 10 is fixed. The boom part 11 is extendible and retractable relative to the boom part 10 and the boom part 12 is extendible and retractable relative to the boom part 11.

The piston and cylinder unit comprises a hollow piston rod 13, a first cylinder 14, a second cylinder 15 and first and second pistons 16 and 17, respectively. The free end of the piston rod 13 is connected to the boom part 10 by a bracket 18. The first cylinder 14 is connected to the boom part 11 by a bracket 19 and the second cylinder 15 is connected to the boom part 12 by a bracket 20.

The piston rod 13 extends into the cylinder 14 through an end 14' thereof and is connected at its inner end to the piston 16. The piston rod 13 is slidable relative to the end 14' of the cylinder 14 and a fluid tight seal is provided between the piston rod 13 and the end 14' by a seal 21. The piston 16 is slidable in the cylinder 14 and divides the cylinder 14 into a first, annular, chamber 14 and a second, cylindrical, chamber **14*b*. A seal 22 in a groove in the piston 16 maintains a fluid tight seal with the wall of the cylinder 14**.

The cylinder 14 extends into the cylinder 15 through an end 15' thereof and is connected at its inner end to the piston 17. The cylinder 14 is slidable relative to the end 15' of the cylinder 15 and a fluid tight seal is provided between the cylinder 14 and the end 15' by a seal 23. The piston 17 is slidable in the cylinder 15 and divides the cylinder into a first, annular, chamber **15*a* and a second, cylindrical, chamber 15***b*. A seal 24 in a groove in the piston 17 maintains a fluid tight seal with the wall of the cylinder 15.

A flexible hose 25 is connected to the base end 15'' of the cylinder 15 to supply and discharge pressurised hydraulic fluid to and from the chamber 15*b*.

A pipe 26 extends through the bracket 18 and into the hollow piston rod 13 to supply and discharge pressurised hydraulic fluid to and from the inside of the piston rod.

Radial holes 27 in the piston rod 13 adjacent to the piston 16 communicate the inside of the piston rod 13 with the chamber 14 of the cylinder 14 and radial holes 28 in the cylinder 14 adjacent to the piston 17 place the chamber 14*b* of the cylinder 14 in closed fluid communication with the chamber 15*a* of the cylinder 15.

A pipe 29 extends through the bracket 18, the piston rod 13 and the piston 16 and a purge pipe 30 is connected to the cylinder 15 adjacent to its end 15' in order that incompressible fluid can be supplied to the chambers 14*b* and 15*a* for initial filling and also for topping up to compensate for any losses or leaks in the closed circuit defined by the chambers 14*b* and 15*a* and the radial holes 28. The pipes 29 and 30 have associated valves 31 and 32, respectively.

In order to extend the piston and cylinder unit from a retracted condition, hydraulic fluid is fed under pressure to the chamber 15*b* of the cylinder 15 via the hose 25 and the pipe 26 is connected to drain. This causes the cylinder 15 to move to the right (as viewed in the single figure) relative to the piston 17 and hence relative to the cylinder 14. The chamber 15*a* of the cylinder 15 therefore contracts and fluid is forced through the radial holes 28 in the cylinder 14 into the chamber 14*b*. This causes the cylinder 14 to move to the right (as viewed in the single figure) relative to the piston rod 13 and fluid in chamber 14*a* is forced through the radial holes 27 and into the piston rod 13 from where it can flow to drain via the pipe 26. Therefore, the cylinder 14 extends relative to the piston rod 13 at the same time as the cylinder 15 extends relative to the cylinder 14 thereby extending the boom part 11 relative to the boom part 10 at the same time as the boom part 12 extends relative to the boom part 11.

In order to retract the piston and cylinder unit from an extended condition, hydraulic fluid is fed under pressure into the hollow piston rod 13 via the pipe 26 and the hose 25 is connected to drain. Fluid passes from the piston rod 13 into the chamber 14*a* of the cylinder 14 via the radial holes 27 and this causes the cylinder 14 to move to the left relative to the piston rod 13. The chamber 14*b* of the cylinder 14 therefore contracts and fluid is forced through the radial holes 28 in the cylinder 14 into the chamber 15*a*. This causes the cylinder 15 to retract relative to the cylinder 14. The chamber 15*b* contracts and fluid in chamber 15*b* flows to drain via hose 25. The boom part 12 therefore retracts relative to the boom part 11 at the same time as the boom part 11 retracts relative to the boom part 10.

It is advantageous to arrange for the volume of the chamber 14*b* (when the piston 16 abuts the end 14' of the cylinder 14) to substantially equal the volume of the chamber 15*a* (when the piston 17 abuts the base end 15'' of the cylinder 15) as this will ensure maximum extension and retraction of the piston and cylinder unit.

The piston and cylinder unit described above is of the double acting type but it could, alternatively, be of a single acting type particularly when used in a vertical orientation to raise and lower loads. Also, as an alternative to providing fluid communication between the pipe 26 and the chamber 14*a* via the piston rod 13 and the radial holes 27, the pipe 26 could be replaced by a flexible hose which is connected to the end 14' of the cylinder 14. In this case, the piston rod 13 need not be hollow.

Also, there may be more than two cylinders providing more than two simultaneous extensions. For example, if there are three cylinders, the cylinder 15 will extend into the third cylinder and be connected to a piston slidable in the third cylinder. The second chamber 15*b* of the cylinder 15 could then be in closed fluid communication with a first chamber of the third cylinder.

What is claimed is:

1. An hydraulic piston and cylinder unit comprising:

a piston rod having first and second ends;

a first cylinder having first and second ends;

a second cylinder having first and second ends;

the piston rod extending into the first cylinder through the first end of the first cylinder and being slidable relative thereto and the first cylinder extending into the second cylinder through the first end of the second cylinder and being slidable relative thereto;

a first piston connected to the second end of the piston rod and slidable within the first cylinder, the first piston dividing the first cylinder into a first chamber adjacent to its first end and a second chamber adjacent to its second end;

a second piston connected to the second end of the first cylinder and slidable within the second cylinder, the second piston dividing the second cylinder into a first chamber adjacent to its first end and a second chamber adjacent to its second end;

the second chamber of the first cylinder and the first chamber of the second cylinder being in closed fluid communication with each other so that extension of the second cylinder relative to the first cylinder causes extension of the first cylinder relative to the piston rod;

a fluid supply system for connecting and supplying an incompressible fluid to said second chamber of said first cylinder and thereby to said first chamber of said second cylinder, and including a purging system connected to said first chamber of the second cylinder for filling said chambers in said closed communication with said imcompressible fluid and compensating for fluid losses therein.

2. A piston and cylinder unit as claimed in claim 1, wherein said closed communication includes a plurality of circumferentially spaced openings adjacent the second piston of said first cylinder, and wherein means are provided for supplying fluid under pressure to the first chamber of the first cylinder in order to retract the first cylinder relative to the piston rod and cause the second cylinder to retract relative to the first cylinder.

3. A piston and cylinder unit as claimed in claim 2, wherein the piston rod is hollow and is in fluid communication with the first chamber of the first cylinder and wherein the fluid supply means are connected to the hollow piston rod.

4. A piston and cylinder unit as claimed in claim 1, wherein the said supply system includes first passage means extending through the piston rod and the first piston so as to communicate with the second chamber of the first cylinder and second passage means in the wall of the first cylinder adjacent the second piston of the second end of the first cylinder to establish said closed communication with the first chamber of the second cylinder.

5. A piston and cylinder unit as claimed in claim 1, wherein the piston rod is fixed and the first and second cylinders are extendible and retractable relative to the piston rod.

6. A piston and cylinder unit as claimed in claim 1, wherein there are only two cylinders and wherein a flexible supply line is connected to the second end of the second cylinder for supplying fluid under pressure directly to the second chamber of the second cylinder to extend the piston rod nd the first and second cylinders relative to one another.

7. A piston and cylinder unit as claimed in claim 1, wherein the volume of the second chamber of the first cylinder (when the first piston abuts the first end of the first cylinder) is substantially equal to the volume of the first chamber of the second cylinder (when the second piston abuts the second end of the second cylinder).

8. A piston and cylinder unit as claimed in claim 1, in combination with a telescopic boom having first, second and third boom members connected to the piston rod, the first cylinder and the second cylinder, respectively.

9. A double acting hydraulic piston and cylinder unit comprising:

a piston rod having first and second ends;

a first cylinder having first and second ends;

a second cylinder having first and second ends;

the piston rod extending into the first cylinder through the first end of the first cylinder and being slidable relative thereto and the first cylinder extending into the second cylinder through the first end of the second cylinder and being slidable relative thereto;

a first piston connected to the second end of the piston rod and slidable within the first cylinder, the first piston dividing the first cylinder into a first chamber adjacent to its first end and a second chamber adjacent to its second end;

a second piston connected to the second end of the first cylinder and slidable within the second cylinder, the second piston dividing the second cylinder into a first chamber adjacent to its first end and a second chamber adjacent to its second end;

the first cylinder having passage means adjacent to its second end communicating the second chamber of the first cylinder with the first chamber of the second cylinder, the second chamber of the first cylinder and the first chamber of the second cylinder being in use, filled with incompressible fluid;

a flexible supply line connected directly to the outer end of said second cylinder for supplying fluid pressure directly to the second chamber of the second cylinder, whereby in use, the piston rod and the first and second cylinders can be extended simultaneously from retracted conditions relative to one another by applying fluid pressure to the second chamber of the second cylinder and can be retracted simultaneously from extended conditions relative to one another by applying fluid pressure to the first chamber of the first cylinder.

10. The unit of claim 9, wherein said flexible supply line is a flexible hose.

* * * * *